US008720090B1

(12) United States Patent
Lehrkamp

(10) Patent No.: US 8,720,090 B1
(45) Date of Patent: May 13, 2014

(54) SIGN DISPLAY SYSTEM WHICH ACCOMMODATES INTERCHANGEABLE PANELS IN A TAMPER RESISTANT MANNER

(71) Applicant: InPro Corporation, Muskego, WI (US)

(72) Inventor: Roger W. Lehrkamp, Milwaukee, WI (US)

(73) Assignee: InPro Corporation, Muskego, WI (US)

( * ) Notice: Subject to any disclaimer, the term of this patent is extended or adjusted under 35 U.S.C. 154(b) by 1 day.

(21) Appl. No.: 13/656,404

(22) Filed: Oct. 19, 2012

(51) Int. Cl.
*G09F 15/00* (2006.01)
*G09F 7/18* (2006.01)

(52) U.S. Cl.
CPC ..... *G09F 15/0012* (2013.01); *G09F 7/18* (2013.01); *G09F 2007/1834* (2013.01); *G09F 2007/1843* (2013.01)
USPC ..... 40/606.09; 40/611.08; 40/611.06

(58) Field of Classification Search
CPC ..... G09F 15/0012; G09F 7/18; G09F 2007/1834; G09F 2007/1843
USPC ..... 40/606.09, 611.07, 611.08, 611.06, 568
See application file for complete search history.

(56) References Cited

U.S. PATENT DOCUMENTS 1,028,279 A * 6/1912 Richardson et al. ..... 40/607.02
4,138,787 A 2/1979 Sarkisian et al.
4,357,773 A 11/1982 Dennis
4,641,448 A * 2/1987 Cobb et al. ..... 40/607.02
4,802,296 A * 2/1989 Kovalak, Jr. ..... 40/607.02
4,991,334 A * 2/1991 Amundsen ..... 40/568
5,012,603 A * 5/1991 Elcock ..... 40/605
5,343,646 A 9/1994 Cobb et al.
5,987,794 A 11/1999 Lavi et al.
6,421,940 B1 7/2002 Cobb et al.
6,438,880 B2 * 8/2002 Dundorf ..... 40/618
6,493,975 B1 12/2002 Cobb et al.
7,055,275 B1 6/2006 Teza et al.
7,143,535 B1 * 12/2006 Cobb et al. ..... 40/611.08
7,293,382 B2 * 11/2007 Polvere et al. ..... 40/611.02

(Continued)

OTHER PUBLICATIONS

On Line Catalog Page of Micro Plastics, Inc. @ https://secure.microplastics.com/catalogfull.aspx?srch=61rr250188&sec=%ED%89%83%E%AA%B2%EE%BD%98%EA%A1%9D%E-C%97%8D%EF%9E%9A%E2%92%83%E1%93%96 For Part 61RR250188, Removable Rivet, With Copyright Notice of 2009.

*Primary Examiner* — Gary Hoge
(74) *Attorney, Agent, or Firm* — Lawrence S Pope

(57) ABSTRACT

This disclosure is concerned with a readily changeable sign display system which facilitates easy alteration of the sign indicia displayed but is also resistant to unauthorized tampering so that it can be deployed where it is not under continuous surveillance when exposed to the general public. It comprises vertical frame members which provide tracks for the insertion of horizontal frame members. In some embodiments the vertical frame members are joined to each other with a backing member while in other embodiments intermediate channel members are placed between the vertical frame members and adjacent members are joined by a backing member. The horizontal frame members carry grooves for the insertion of sign panels which carry indicia. The tracks for the horizontal frame members carry removable obstructions which hold these members in the tracks. The obstructions at the upper end of the tracks are readily removable.

20 Claims, 9 Drawing Sheets

(56) References Cited

U.S. PATENT DOCUMENTS

| | | | | |
|---|---|---|---|---|
| 7,308,769 | B2 | 12/2007 | Labedz | |
| 7,412,791 | B2 | 8/2008 | Bradley et al. | |
| 7,484,325 | B2 | 2/2009 | Benedict et al. | |
| 7,565,760 | B2 * | 7/2009 | Maier-Hunke | 40/611.08 |
| 7,797,868 | B1 | 9/2010 | Cobb et al. | |
| 2002/0026737 | A1 | 3/2002 | Tramont | |
| 2005/0166431 | A1 | 8/2005 | Boron et al. | |
| 2006/0260167 | A1 * | 11/2006 | Harkins | 40/618 |

* cited by examiner

SIGN DISPLAY SYSTEM WHICH ACCOMMODATES INTERCHANGEABLE PANELS IN A TAMPER RESISTANT MANNER

BACKGROUND OF THE INVENTION

There are numerous designs for sign systems in which the messages imparted by the overall sign can be changed. The location of the sign system may have an impact on the ease with which these messages may be changed. One convenient approach is a sign system with changeable panels. On the one hand, there is a desire to facilitate changes and minimize the time and effort involved. But if the sign system is located where it is not under continual surveillance by authorized person while it is exposed to the general public, there is a concern with inhibiting unauthorized changes. These opposing goals are readily evident in the case of directional signs in buildings with multiple facilities, such as an office building with multiple tenants. The signs are often located where they are only observed by the general public during the time that the building is open but frequently require alteration as tenants change. It is advantageous if the changes can be made without the need to have a key or other unique opening device.

SUMMARY OF THE INVENTION

The present invention involves a sign system which accommodates interchangeable panels which can be readily loaded into and removed from a frame structure but which are secured in a manner which inhibits tampering once the panels are in place. The panels are preferably flat rectangular pieces with information displayed on one or both of their faces. The sign system preferably comprises vertical frame members which are designed to be affixed to some structure, such as a wall, that is located at the site where the information on the panels is to be displayed. These frame members should each carry a vertical groove which extends from the top edge of its frame member along the frame member's long dimension. The frame members used in a given sign system should preferably have grooves of the same width and in a preferred embodiment the grooves should also have the same depth. In a particularly preferred embodiment the frame members of a given sign system are essentially identical to each other. In a preferred embodiment these frame members are mounted on one or more flat backing members which hold these frame members parallel to each other at a fixed distance from each other with their grooves facing each other. In a preferred embodiment the backing members extend into the grooves of the backing members. In one preferred embodiment two framing members are affixed to a common backing member with their grooves facing each other. In another preferred embodiment one or more intermediate channel members is interposed between the vertical framing members. This intermediate channel member has two grooves running along its long dimension and facing out in two opposite directions. Theses grooves should have about the same width and more preferably the same depth as the grooves carried by the vertical frame members. It is preferred that a separate backing member be used to connect each vertical frame member to its adjacent intermediate channel member and it is particularly preferred that the backing member joining a given vertical frame member to its adjacent intermediate channel member extend into the grooves of both. In sign systems with more than one intermediate channel member it is preferred that adjacent intermediate channel members be joined by separate backing members such that a separate backing member runs between each pair of adjacent vertical members whether they are vertical frame members, intermediate channel members or a combination of the two. It is particularly preferred that every backing member extend into the appropriate grooves of the two vertical members which it joins.

The vertical frame members and the intermediate channel members, when present, provide via their grooves tracks for horizontal frame members. These horizontal frame members comprise an essentially flat back portion which has two opposed sides which each carry a flange which is generally perpendicular to the flat back portion. Each flange in turn carries a groove which faces inward toward the groove carried by the other flange. The two grooves have about the same width and preferably the same depth. These two grooves provide a track for the insertion of a sign panel. In this regard, one of the other sides of the horizontal frame member is unobstructed such that a sign panel can be readily slid into and out of the tracks provided by the grooves carried by the flanges. In a preferred embodiment the horizontal frame member has a generally rectangular shape and in a particularly preferred embodiment both of the edges of this rectangular shape which do not carry flanges with the opposed grooves are unobstructed such that sign panels can be readily slid in and out of the tracks provided by the grooves carried by the flanges. In another embodiment the horizontal frame member is provided in two similar pieces, each of which is of the same width and has a flange with a groove which faces inward towards its flat back portion. When mounted in the track provided by the vertical frame members and/or the intermediate channel members, the two grooves provide a track for holding a sign panel. In this case the sign panel is typically loaded into the upward facing groove and then the downward facing groove is placed over the sign panel. This arrangement accommodates sign panels of various heights greater than can be conveniently accommodated with a single piece horizontal frame member.

Each of the tracks for the horizontal frame members provided by the grooves of two vertical frame members, two intermediate channel members or a combination of one of each is provided with one or more semi-permanent obstructions at its bottom terminus such that vertical frame members can be loaded into a track from the top and be retained within the track. Preferably the obstructions are affixed to the two vertical frame members, the intermediate channel members or both. In a particularly preferred embodiment the obstructions are caps which extend from the center of a frame or channel member across the groove or grooves carried by this member. In a particularly preferred embodiment these frame and channel members carry a recess which accommodates a fastener which passes through the cap. In an alternative embodiment the obstruction is provided by a member which is affixed to the backing member which joins the frame and/or channel members which define a given track. In this embodiment the obstruction may conveniently be a right angle piece with one arm being parallel to and affixed to the backing member, for example with an adhesive, and the other arm extending perpendicularly from the backing member across the track.

Each of these tracks is also provided with one or more readily removable obstructions at its upper end. In a preferred embodiment the obstructions are affixed to the two vertical frame members, the intermediate channel members or both. The obstructions should be affixed in a manner such that they can readily be removed with less effort than the removal of screw which requires multiple rotations for removal. In a preferred embodiment the obstructions are affixed using two piece removable rivets in which a central portion can be easily withdrawn by the application of a small amount of force beneath its head and this in turn allows the main body of the rivet to be withdrawn. In an alternative embodiment the obstructions may be affixed using magnetic attraction, for instance by having the obstruction be at least partially constructed of a magnetically responsive metal like steel and having the backing member carry a small flat appropriately placed magnet. In a particularly preferred embodiment the obstructions are caps which extend from the center of a frame or channel member across the groove or grooves carried by this member in a manner similar to that of the caps which may be used as obstructions at the bottom terminus of the tracks. In a particularly preferred embodiment these frame and channel members carry a recess which accommodates a readily removable fastener such as a two piece removable rivet which passes through the cap. In an alternative embodiment the obstruction is provided by a member which is affixed to the backing member which joins the frame and/or channel members which define a given track. In this embodiment the obstruction may conveniently be a right angle piece with one arm being parallel to and affixed to the backing member, for example by magnetic attraction, and the other arm extending perpendicularly from the backing member across the track.

DETAILED DESCRIPTION

Figure 1:
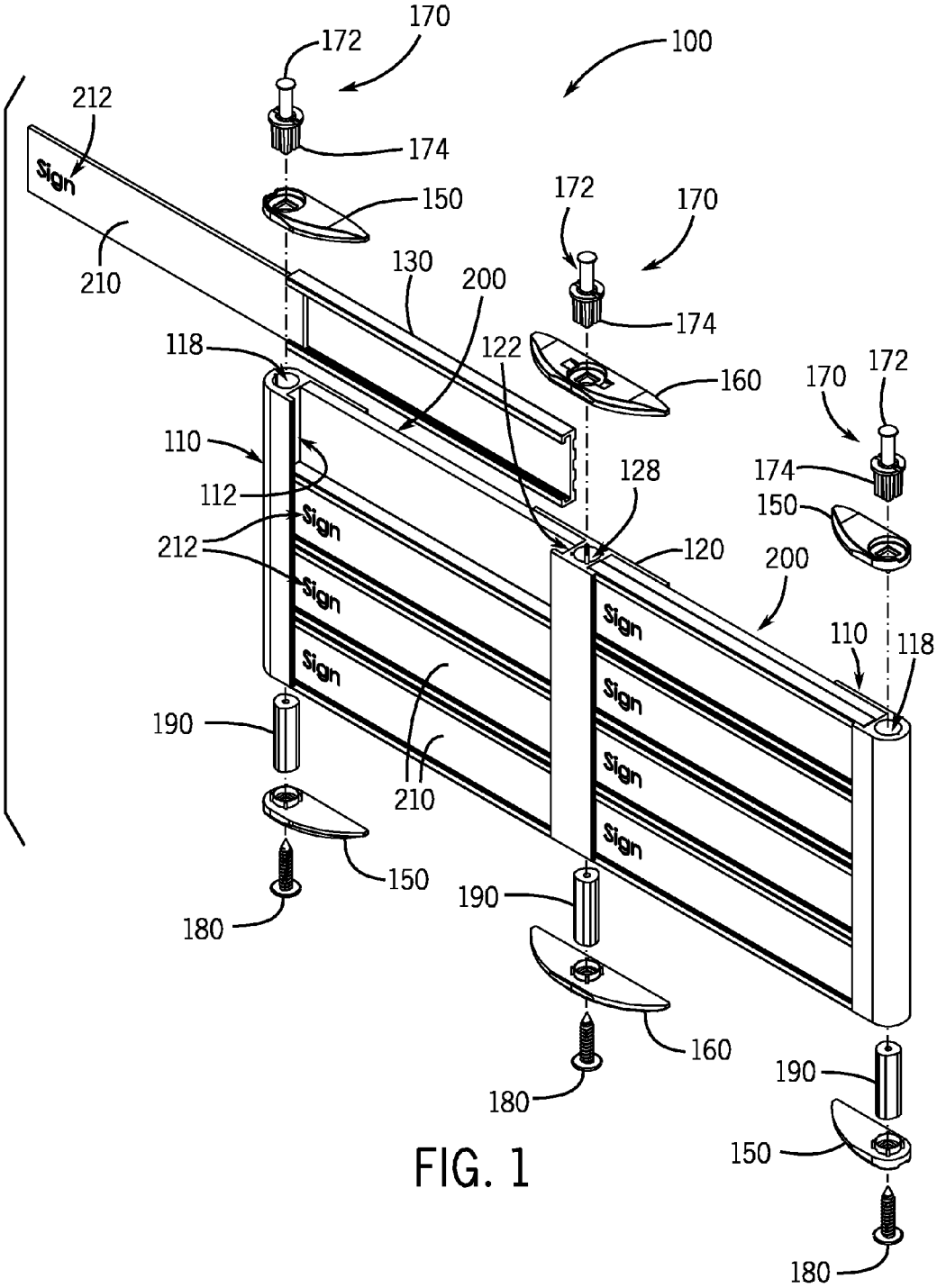
FIG. 1 is a perspective view of a sign display system showing the all the elements of the system as well as the sign panels which it is used to display.

One embodiment of the sign display system 100 with which the present invention is concerned is illustrated in FIG. 1. A vertical frame member 110 is joined to the left side of an intermediate channel member 120 by a flat backing member 200. The flat backing member 200 has been inserted into the groove 112 (Illustrated in FIG. 2) of the vertical frame member 110 and one of the grooves 122 (Illustrated in FIG. 3) of the intermediate channel member 120. It may be conveniently adhesively adhered to the appropriate portion of the back plate 114 (Illustrated in FIG. 2) of the vertical frame member 110 and to the appropriate portion of the back plate 124 (Illustrated in FIG. 3) of the intermediate channel member 120. Thus the flat backing member 200 serves to hold the vertical frame member 110 and the intermediate channel member 120 parallel to each other and to align their grooves 112 and 124 such that they face each other. The facing grooves 112 and 122 define a track for the horizontal frame members 130. Each horizontal frame member 130 may carry a sign panel 210 which bears informational indicia 210. The horizontal frame members 130 are retained in the sign display system 100 by the side caps 150 and the center caps 160. Both caps 150 and caps 160 have a portion which extends over one of the grooves 112 and 122. The side cap 150 and the center cap 160 which are affixed to the top of the sign display system 100 are secured by removable two piece rivets 170 which consist of a center pin 172 and a four lobe body 174. The vertical frame member 110 has a fastener receptacle 118 to receive the four lobe body 174 and the intermediate channel member 120 has a fastener receptacle 128 to receive the four lobe body 174. The side cap 150 and the center cap 160 which are affixed to the bottom of the sign display system 100 are secured by a semi-permanent combination of a screw 180 and an anchor 190. Both the vertical frame member 110 and the intermediate channel member 120 have respective recesses 118 and 128 to receive the anchors 190. In this regard, both the vertical frame member 110 and the intermediate channel member 120 are symmetrical about the horizontal plane such that each can be rotated 180° and still mate with each other and accept the removable two piece rivets 170 at the top and the screws 180 and anchors 190 at the bottom.

A second vertical frame member 110 is joined to the right side of the intermediate channel member 120 by a flat backing member 200 in the same manner and it carries side caps 150 at its top and bottom in the same manner as the first vertical frame member 110 using the anchor 190 and screw 180 at the bottom and the two piece removable rivet 170 at the top.

Figure 2:
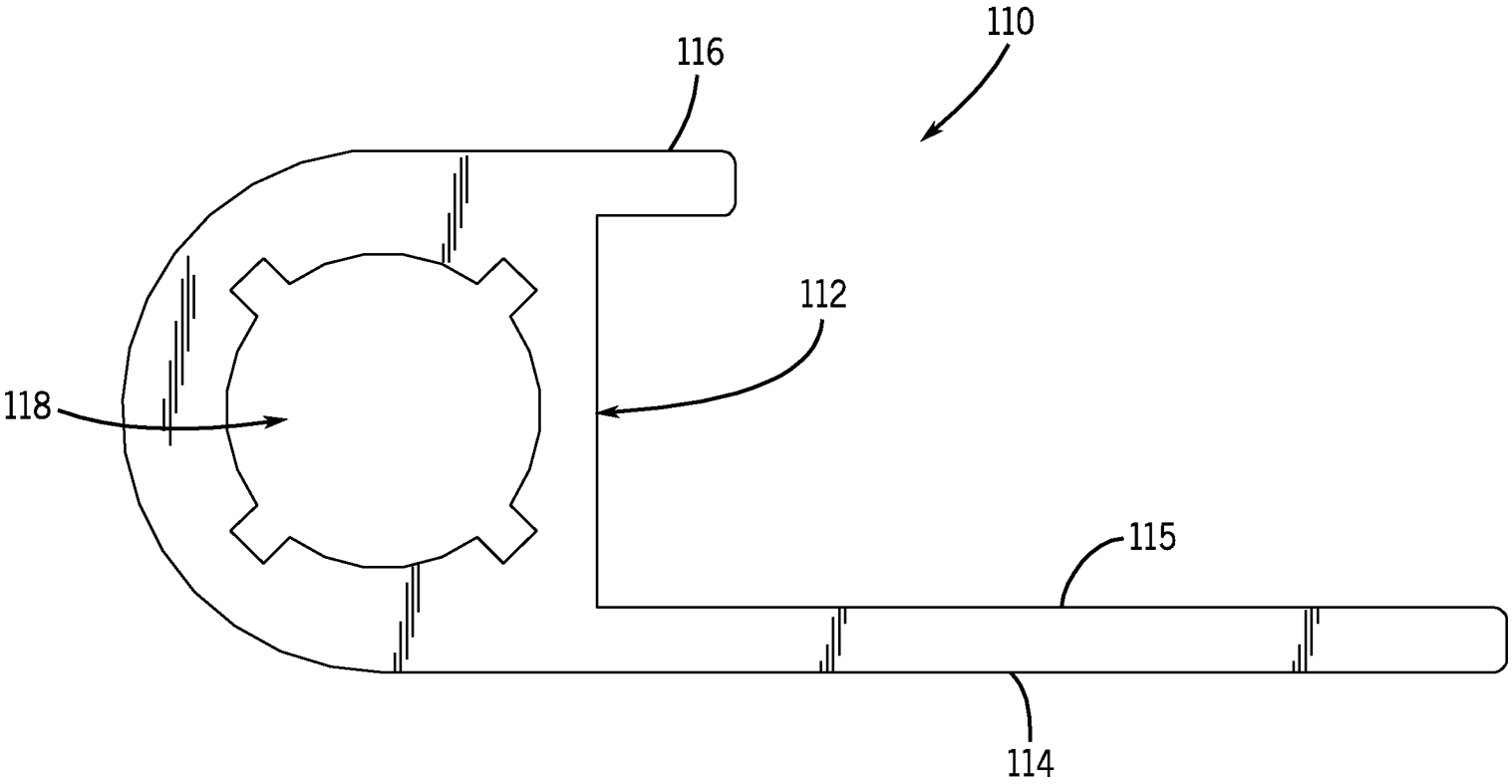
FIG. 2 is a top view of a vertical frame member used to provide mounting tracks
Figure 3:
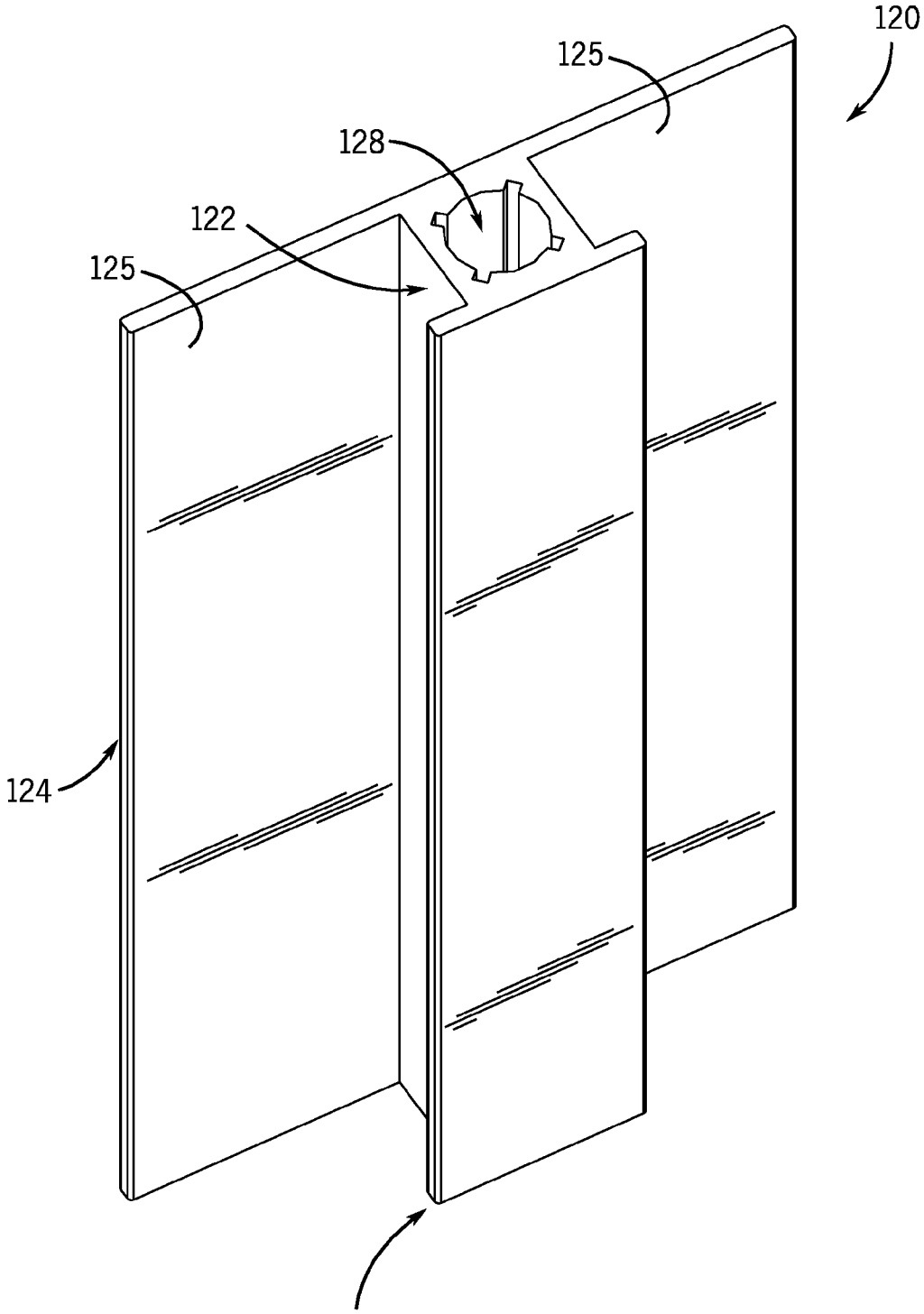
FIG. 3 is a perspective view of an intermediate channel member which, when used, cooperates with vertical frame members and/or other intermediate channel members to define tracks for the horizontal frame members.
Figure 4:
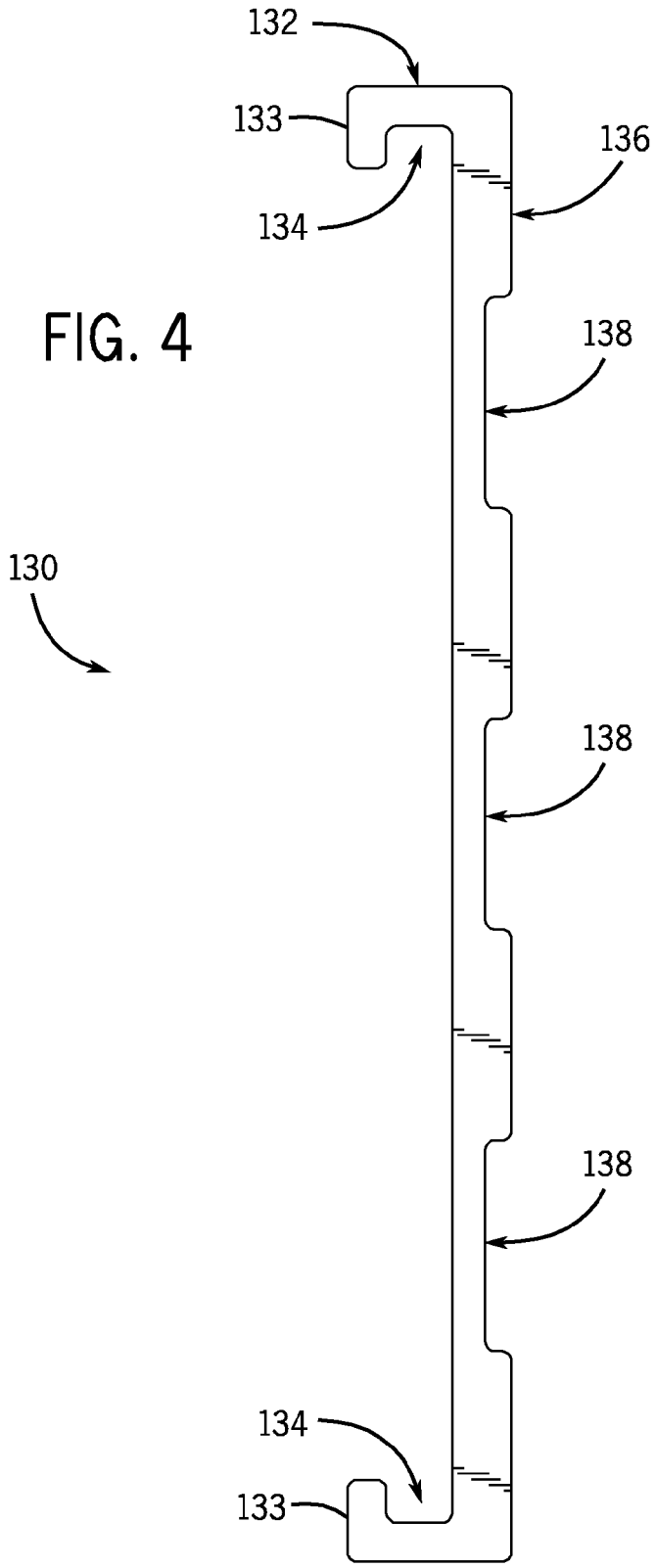
FIG. 4 is a side elevation of a horizontal frame member which is used to carry sign panels carrying indicia.

The detailed construction of the major members is illustrated in FIG. 2-4. The vertical frame member 110 has a groove 112 to accommodate the flat backing member 200 as well as the horizontal frame member 130. The groove 112 is formed between the back plate 114 and the front plate 116. The back plate 114 provides an interior surface 115 to which the flat backing member 200 may be adhesively adhered. The vertical frame member 110 also has a fastener receptacle 118 which can accommodate either the four lobe body 174 of the two piece removable rivet 170 or the anchor 190 and the screw 180. The vertical frame member 110 has mirror image symmetry across a plane extending in z direction so that it can serve as either the left hand or the right hand terminus of the sign display system 100. The intermediate channel member 120 has two grooves 122 which each accommodate a flat backing member 200 as well as a horizontal frame member 130. The grooves 122 are formed between the back plate 114 and the front plate 116. The back plate 124 provides an interior surface 125 to which the flat backing members 200 may be adhesively adhered. The horizontal frame member 130 has two grooves 134 which accommodate a sign panel 210. These grooves 134 are formed in its flanges 132. The horizontal frame member 130 has a back portion 136 which in combination with the flange front face 133 provides the appropriate thickness to fit fairly snugly in the grooves 112 and 122 of the vertical frame member 110 and the intermediate channel member 120, respectively, when a portion of each groove is already occupied by a flat backing member 200. The back portion 136 has a series of indentations 138 which serve to reduce the total amount of material needed to fabricate the horizontal frame member 130.

Figure 5:
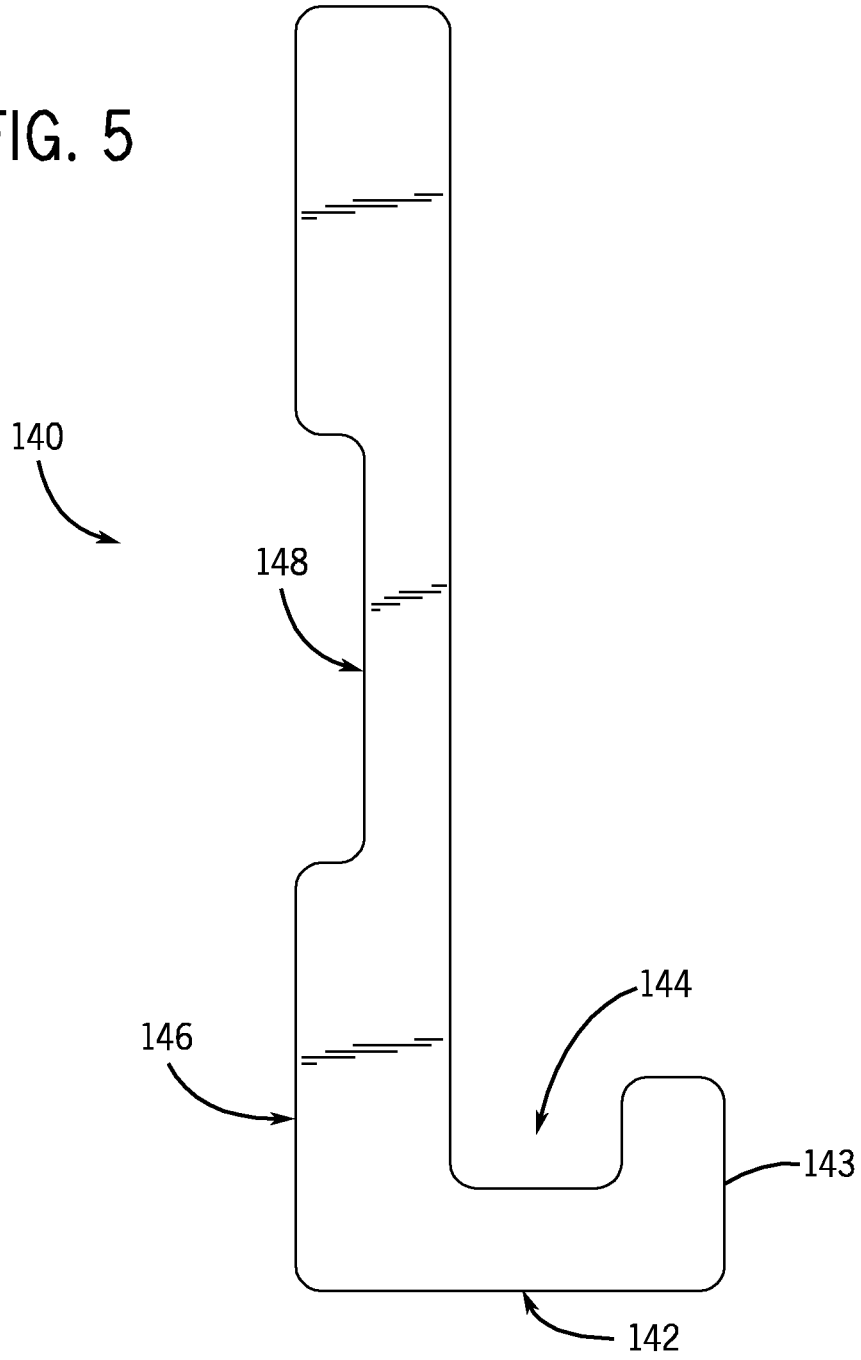
FIG. 5 is a side elevation of a partial horizontal frame member which is one of a pair used to hold larger sign panels carrying indicia.

An alternative partial horizontal frame member is illustrated in FIG. 5. It has a single groove 144 formed in its single flange 142. It has a back portion 146 which in combination with the flange front face 143 provides the appropriate thickness to fit fairly snugly in the grooves 112 and 122 of the vertical frame member 110 and the intermediate channel member 120, respectively, when a portion of each groove is already occupied by a flat backing member 200. The back portion 146 has an indentation 148 which serves to reduce the total amount of material needed to fabricate the partial horizontal frame member 140. In cases in which it is inconvenient to fabricate a single horizontal frame member 130 to accommodate a particularly tall sign panel 210, a partial horizontal frame member 140 may be positioned over the top and the bottom of the sign panel 210. One procedure would be to load one partial horizontal frame member 140 into the track defined by a vertical frame member 110 and the intermediate channel member 120, place the particularly tall sign panel 210 into the groove 140 of this partial horizontal frame member 140 and then place another partial horizontal frame member 140 into this track so that its groove 144 fit over the top of this sign panel 210.

Figure 6:
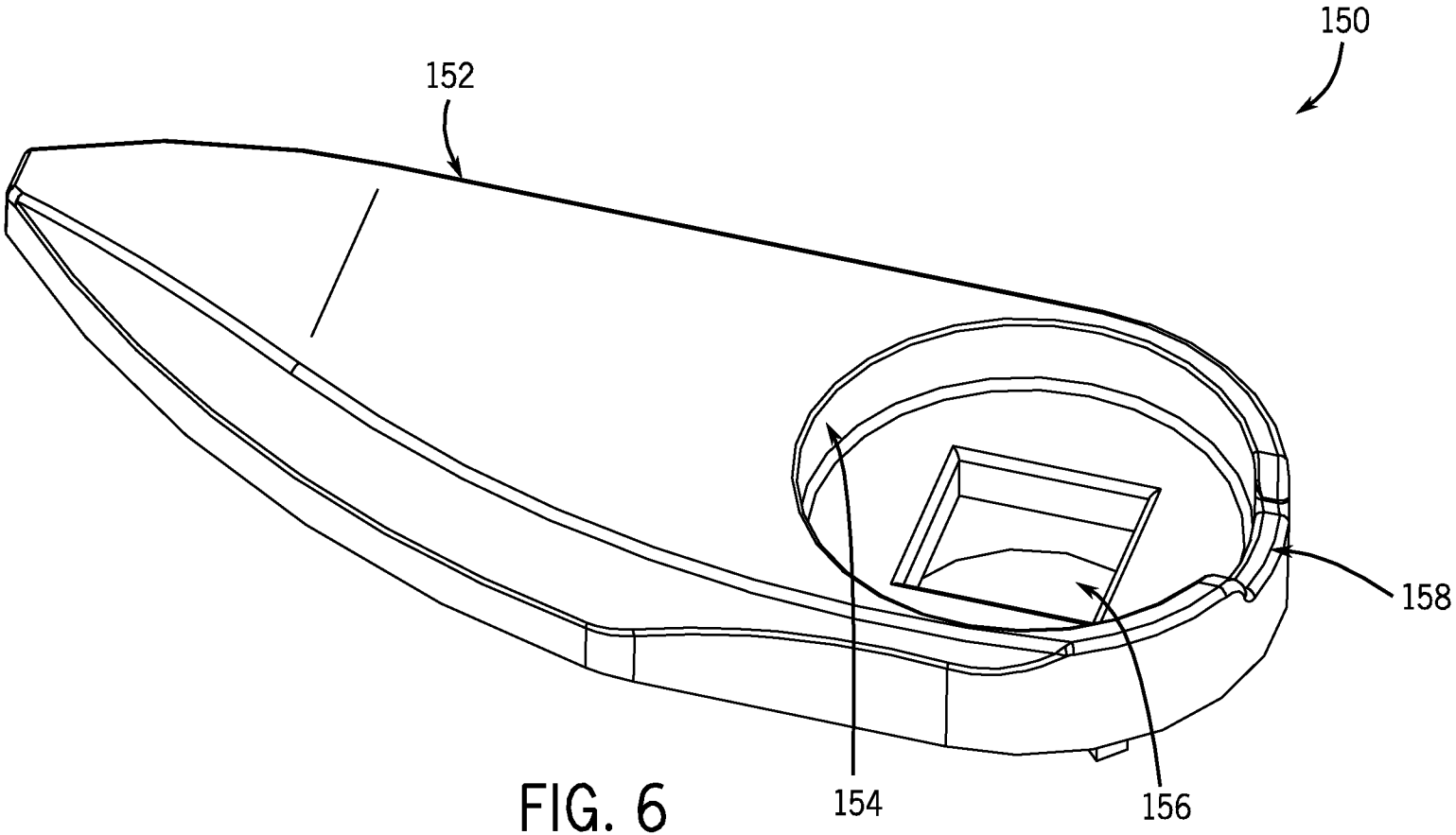
FIG. 6 is a perspective view of an obstruction which cooperates with a vertical frame member to close a track for a horizontal frame member.

The side caps 150 which are affixed to the top and the bottom of the vertical frame members 110 are illustrated in FIG. 6. They have wings 152 which extend over the grooves 112 of the vertical frame members 110. They also have a well 154 which accommodates either the head 171 of the two piece removable rivet 170 or the head of the screw 180. They also have an aperture 156 through which the rivet 170 or the screw 180 passes when seating in the fastener receptacle 118 of a vertical frame member 110. They also have an access channel 158 which allows access to the head 176 (Illustrated in FIG. 8) of the rivet center pin 172 to facilitate removal of the center pin and consequently the four lobe body 174. This channel 158 is, of course, unnecessary when the side caps 150 is affixed to the bottom of a vertical frame member 110 but it is convenient to mold a common side cap 150 for both the top and the bottom.

Figure 7:
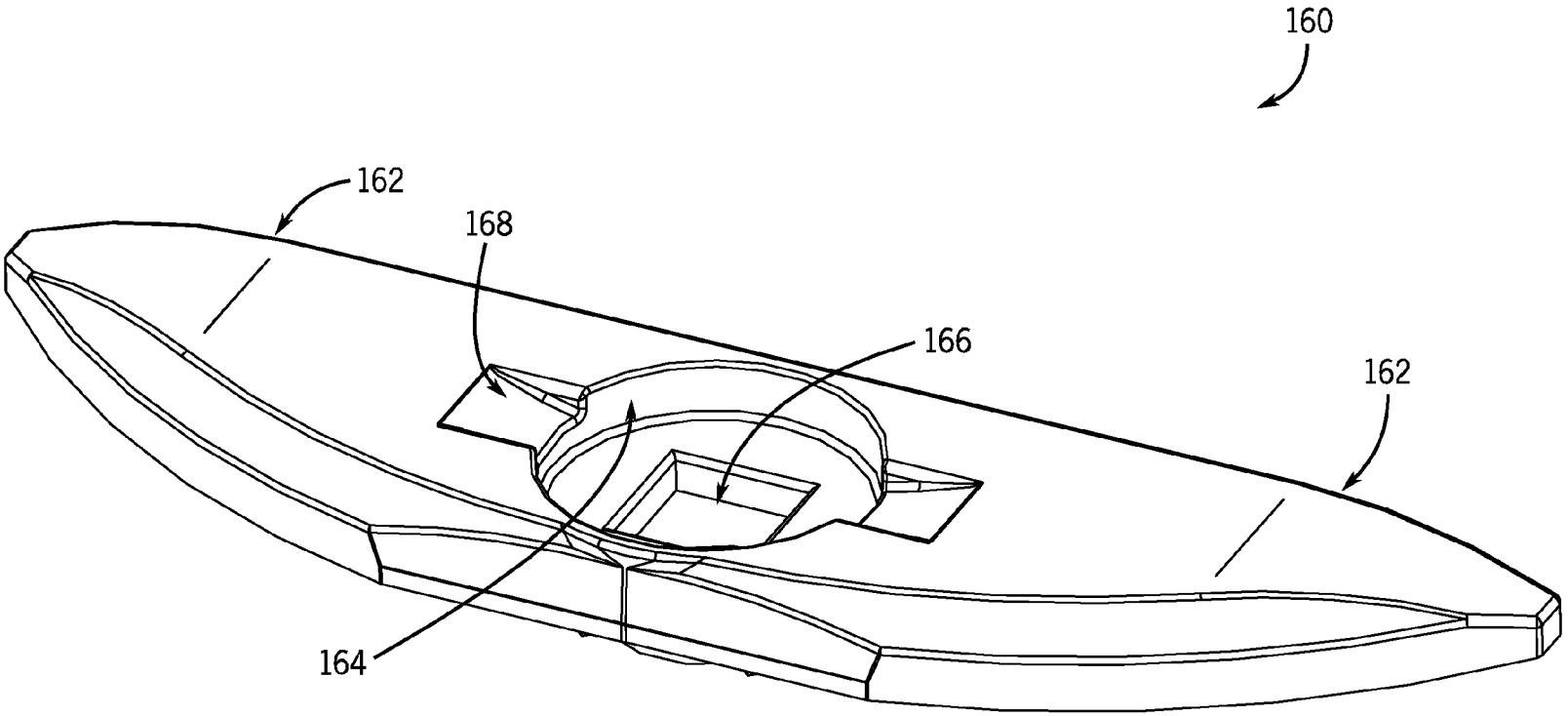
FIG. 7 is a perspective view of an obstruction which cooperates with an intermediate channel member to close tracks for the horizontal frame members.

The center caps 160 which are affixed to the top and the bottom of the intermediate channel member 120 are illustrated in FIG. 7. They have wings 162 which extend over the grooves 122 of the intermediate channel member 120. They also have a well 164 which accommodates either the head 171 of the two piece removable rivet 170 or the head of the screw 180. They also have an aperture 166 through which the rivet 170 or the screw 180 passes when seating in the fattener receptacle 128 of the intermediate channel member 120. They also have access channels 168 which allow access to the head 176 (Illustrated in FIG. 8) of the rivet center pin 172 to facilitate removal of the center pin and consequently the four lobe body 174. These channels 168 are, of course, unnecessary when the obstruction 150 is affixed to the bottom of the intermediate channel member but it is convenient to mold a common center cap 160 for both the top and the bottom.

Figure 8:
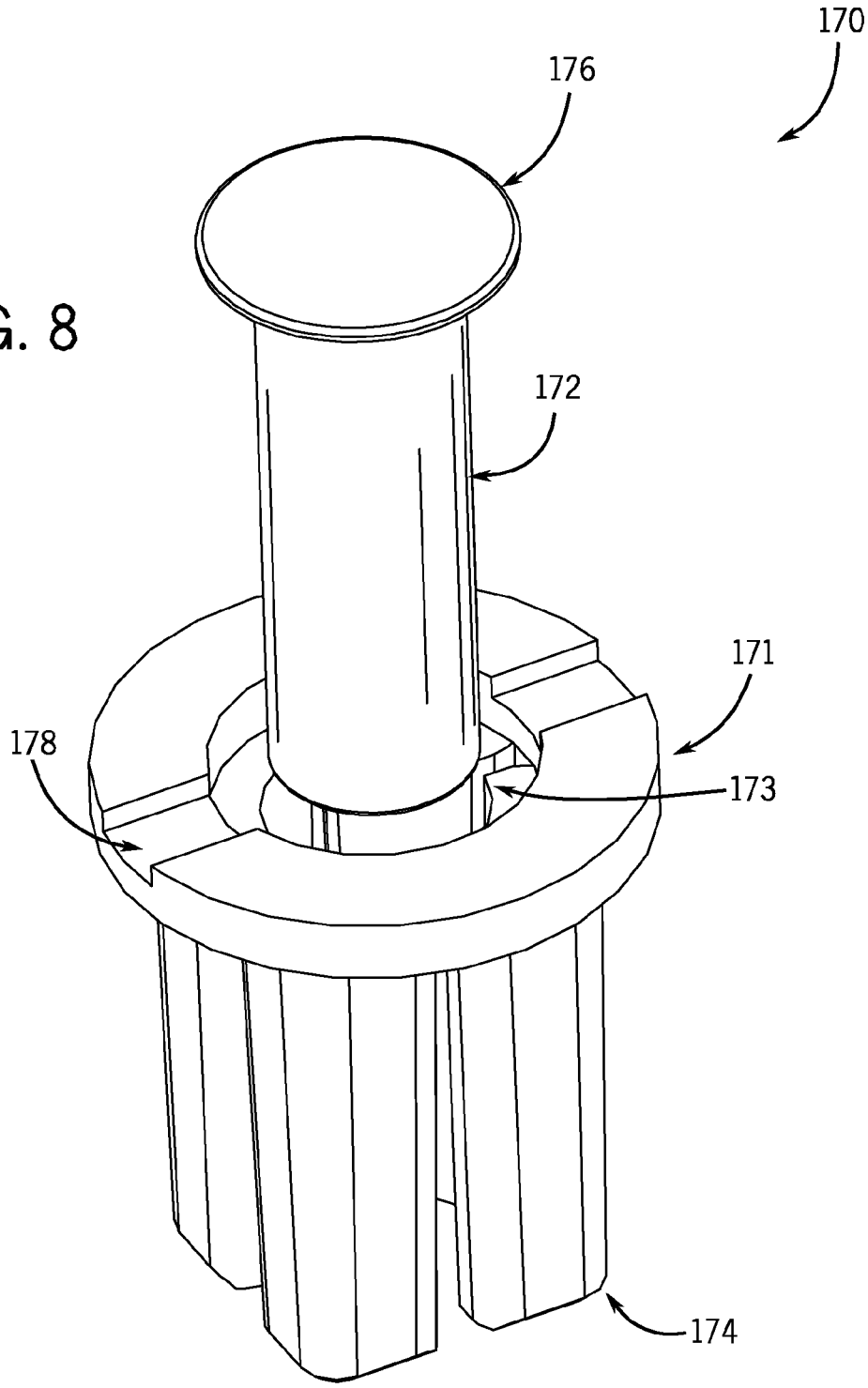
FIG. 8 is a perspective view of a two piece removable rivet with its center pin removed which is used to affix an obstruction to a vertical frame member or an intermediate channel member.
Figure 9:
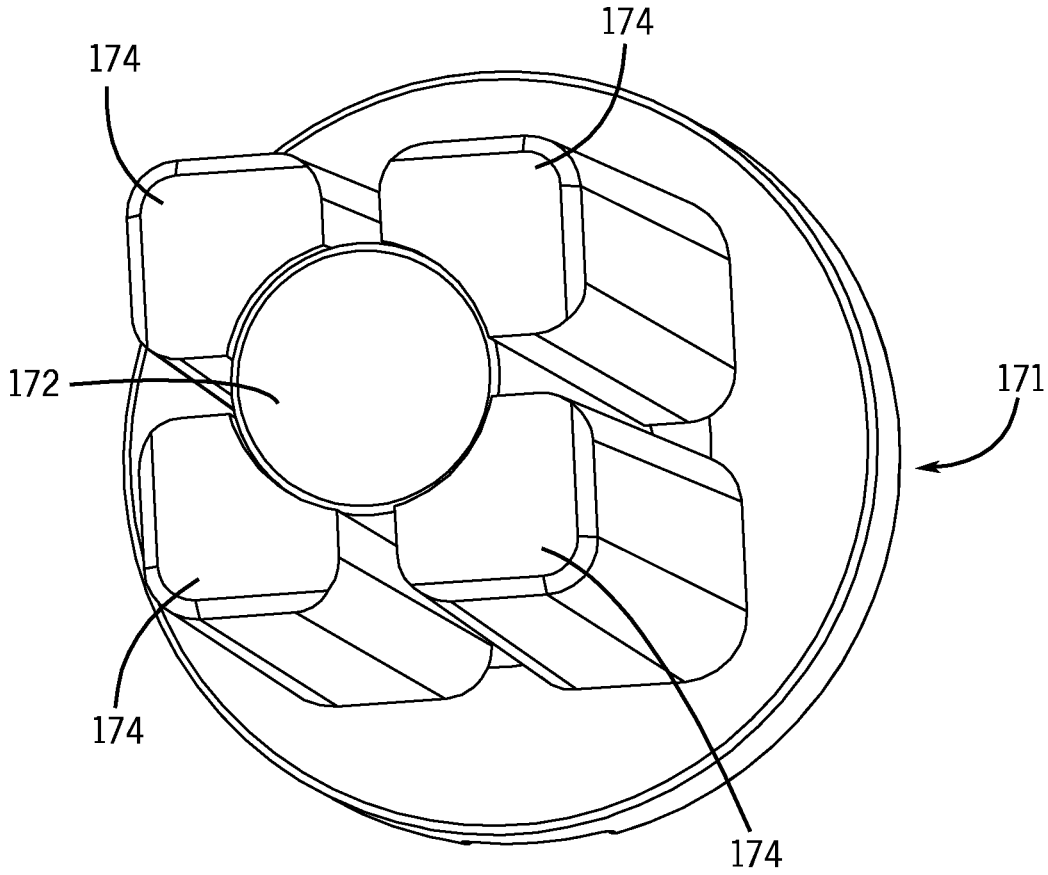
FIG. 9 is a perspective view of a two piece removable rivet with its center pin in a locking position.

The details of the construction of the two piece removable rivet 170 are illustrated in FIGS. 8 and 9. A center pin 172 with a head 176 is used to lock the rivet in place. It passes through the aperture 173 of the four lobe body 174. The head 171 of the two piece removable rivet 170 seats in the well 154 or 164 of the side or center caps 150 or 160, respectively. When the center pin 172 is inserted it caused the four lobe body 174 to expand. In this manner a rivet 170 may be locked in place in the fastener receptacle 118 or 128 of the vertical frame member 110 or the intermediate channel member 120, respectively. The head 171 is provided with access channels 178 which allow access to the head 176 thus facilitating removal of the center pin 172 and consequently the four lobe body 174. These channels 178 cooperate with the access channel 158 of the side cap 150 or with the access channels 168 of the center cap 160.

A typical sign display system is between about 1.425 inches and 9.05 inches tall and about 7.1 inches wide without an intermediate channel member and about 14.5 inches wide with one intermediate channel member. The typical horizontal frame member accommodates a sign panel that is about 6.1 inches in width and between 2 and 8 inches in height.

The vertical frame member, the intermediate channel member and the horizontal frame member are preferably made of metal and more preferably, for ease and economy of manufacturing, of extruded metal. It is especially preferred to fabricate them as extruded aluminum parts. This not only provides for ease and economy of manufacturing but also provides a sign display system which is light weight and corrosion resistant.

The flat backing member and the end and center caps are conveniently made of plastic. The flat backing member is preferably made of a plastic material available in readily cut sheets such as ABS. The end and center caps are preferably fabricated by injection molding.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A readily loadable sign display system comprising:

a. two vertical frame members, each of which is elongated in one direction and has a groove running in that direction, said grooves having about the same width, said vertical frame members being held parallel to each other with their grooves facing each other to define one or more tracks which accommodate horizontal frame members;

b. a plurality of said horizontal frame members, each of which has a generally rectangular configuration and comprises:

i. a generally flat back portion; and ii. two flange portions which extend along two opposite edges of said back portion and are generally perpendicular to said back portion, each of said flange portions carrying a groove which faces the groove of the other flange portion such that said grooves provide parallel tracks for the insertion of a sign panel from one or both of the edges of the back portion that does not carry a flange, iii. said flange portions each having a height above said back portion such that said horizontal frame members can fit within said grooves of said vertical frame members and readily slide along said grooves; and c. an obstruction adapted to be affixed to each end of said tracks defined by said vertical frame members, with the obstructions at one end of said tracks being adapted to be readily removable and the obstructions at the other end being adapted to be semi-permanently attached and non-destructively removed such that their removal requires significantly more effort than the removal of the obstructions at the other end.

2. The sign display system of claim 1 wherein a flat backing member is inserted into and affixed to the groove of each vertical frame member, such that adjacent members are joined by and held parallel to each other by a flat backing member.

3. The sign display system of claim 2 wherein an obstruction at one end of at least one of said tracks is semi-permanently affixed to the flat backing member which joins the two members which defines said track.

4. The sign display system of claim 3 wherein said obstruction is adhesively affixed to said flat backing member.

5. The sign display system of claim 1 wherein a flat backing member joins two vertical frame members and said vertical frame members define a single track to accommodate said horizontal frame members.

6. The sign display system of claim 1 wherein one or more intermediate channel members are held between and parallel to said vertical frame members, each of said intermediate channel members:

a. being an elongated generally rectangular strip with its long dimension parallel to said vertical frame members;

b. carrying a groove on each side of its long dimension which is of the same width as the grooves of said vertical frame members, with each intermediate channel member defining two tracks with the vertical frame members or other intermediate channel members immediately adjacent to it, each said track accommodating a plurality of horizontal frame members.

7. The sign display system of claim 6 wherein a flat backing member is inserted into and is affixed to each vertical frame member and each intermediate channel member, such that adjacent members are joined by and held parallel to each other by a flat backing member.

8. The sign display system of claim 6 wherein there is a single intermediate channel member between two vertical frame members.

9. The sign display system of claim 6 wherein each of said intermediate channel members has essentially identical grooves along each of its long edges.

10. The sign display system of claim 6 which includes an obstruction adapted to be affixed to each end of each intermediate channel member such that it extends across its grooves.

11. The sign display system of claim 1 which also includes one or more partial horizontal frame members, each said partial horizontal frame member being essentially identical to said horizontal frame members with a generally flat back portion and a single flange portion that extends along one edge of said back portion carrying a groove with a bottom wall perpendicular to said back portion and a front wall parallel to said back portion with an opening which faces in the same direction as the back portion extends, the grove providing a track for the insertion of a sign panel, said flange portion having a height above said back portion such that said partial horizontal frame members can fit within said grooves of said vertical frame members and readily slide along said grooves.

12. The sign display system of claim 1 wherein said vertical frame members are essentially identical.

13. The sign display system of claim 1 wherein obstructions to said tracks are adapted to be affixed to said vertical frame members and extend across the grooves of said vertical frame members.

14. The sign display system of claim 13 which also includes fasteners which are adapted to affix said obstructions to said vertical frame members and said obstructions contain holes to accommodate said fasteners.

15. The sign display system of claim 14 wherein said vertical frame members contain recesses other than their grooves at both of their ends to accommodate said fasteners.

16. The sign display system of claim 1 wherein the vertical frame members and the horizontal frame members are extruded aluminum.

17. A readily loadable sign display system comprising:

a. two vertical frame members, each of which is elongated in one direction and has a groove running in that direction, said grooves having about the same width, said vertical frame members being held parallel to each other with their grooves facing each other to define one or more tracks which accommodate horizontal frame members;

b. a plurality of said horizontal frame members, each of which has a generally rectangular configuration and comprises:

i. generally flat back portion; and ii. two flange portions which extend along two opposite edges of said back portion and are generally perpendicular to said back portion, each of said flange portions carrying a groove which faces the groove of the other flange portion such that said grooves provide parallel tracks for the insertion of a sign panel from one or both of the edges of the back portion that does not carry a flange, iii. said flange portions each having a height above said back portion such that said horizontal frame members can fit within said grooves of said vertical frame members and readily slide along said grooves; and c. an obstruction adapted to be affixed to each end of said tracks defined by said vertical frame members, with the obstructions at one end of said tracks being adapted to be readily removable; and d. fasteners adapted to be used with the readily removable obstructions which are two piece removable rivets with a central pin with a head and an expandable body and the obstructions are configured with one or more channels to facilitate access to said head of said rivet central pin.

18. The sign display system of claim 13 wherein said obstructions adapted to be affixed to said vertical frame members are interchangeable such that any one of them can be affixed to either the end of a track where they are to be readily removable or the end of a track where they are to be semi-permanently affixed.

19. A readily loadable sign display system comprising:

a. two essentially identical vertical frame members, each of which is elongated in one direction and has a groove running in that direction, with each end of each vertical frame member having a recess which accommodates a fastener;

b. a flat backing member inserted into and affixed to said grooves of said vertical frame members such that said members are held parallel to each other with their grooves facing each other to define a track which accommodates horizontal frame members;

c. a plurality of said horizontal frame members, each of which has a generally rectangular configuration and comprises:

i. A generally flat back portion; and ii. two flange portions which extend along two opposite edges of said back portion and are generally perpendicular to said back portion, each of said flange portions carrying a groove which faces the groove of the other flange portion such that said grooves provide parallel tracks for the insertion of a sign panel from one or both of the edges of the back portion that does not carry a flange, said flange portions each having a height above said back portion such that said horizontal frame members can fit within said grooves of said vertical frame members and readily slide along said grooves;

d. a set of essentially identical obstructions adapted to be affixed to the ends of said vertical frame members with fasteners which interact with the recesses in said vertical frame members such that such obstructions extend over said grooves of said vertical frame members and prevent said horizontal frame members from exiting said track ; and e. a set of two piece removable rivets which are adapted to pass through said obstructions and engage said recesses in said vertical frame members.

20. A readily loadable sign display system comprising:

a. an intermediate channel member which is an elongated generally rectangular strip carrying a groove on each side of its long dimension and a recess at each of its ends which accommodates a fastener;

b. two essentially identical vertical frame members, each of which is elongated in one direction such that it has a length equal to that of said intermediate channel member and has a groove running in that direction, with each end of each vertical frame member having a recess which accommodates a fastener;

c. two flat backing members, each inserted into and affixed to the groove of one of said vertical frame members and one of the grooves of said intermediate channel member such that said vertical frame members and said intermediate channel member are held parallel to each other such that the groove of each of said vertical frame members cooperates with a groove of said intermediate channel member to define a track which accommodates horizontal frame members;

d. a plurality of said horizontal frame members, each of which has a generally rectangular configuration and comprises:

i. a generally flat back portion; and ii. two flange portions which extend along two opposite edges of said back portion and are generally perpendicular to said back portion, each of said flange portions carrying a groove which faces the groove of the other flange portion such that said grooves provide parallel tracks for the insertion of a sign panel from one or both of the edges of the back portion that does not carry a flange, said flange portions each having a height above said back portion such that said horizontal frame members can fit within said grooves of said vertical frame members and readily slide along said grooves;

e. a set of essentially identical obstructions adapted to be affixed to the ends of said vertical frame members with fasteners which interact with the recesses in said vertical frame members such that such obstructions extend over said grooves of said vertical frame members and prevent said horizontal frame members from exiting said track;

f. a set of essentially identical obstructions adapted to be affixed to the ends of said intermediate channel member with fasteners which interact with the recesses in said intermediate channel member such that each obstruction extends over both grooves of said intermediate channel member and prevents said horizontal frame members from exiting said track ; and g. a set of two piece removable rivets which are adapted to pass through both types of obstructions and engage said recesses in either said vertical frame members or said intermediate channel member.

* * * * *